US008297642B2

(12) United States Patent
Tyson, III

(10) Patent No.: US 8,297,642 B2
(45) Date of Patent: Oct. 30, 2012

(54) DUAL-CHAIR BEACH WAGON

(76) Inventor: Robert L. Tyson, III, Raleigh, NC (US)

( * ) Notice: Subject to any disclaimer, the term of this patent is extended or adjusted under 35 U.S.C. 154(b) by 582 days.

(21) Appl. No.: 12/585,768

(22) Filed: Sep. 24, 2009

(65) Prior Publication Data

US 2010/0078973 A1 Apr. 1, 2010

Related U.S. Application Data

(60) Provisional application No. 61/136,739, filed on Sep. 29, 2008.

(51) Int. Cl.
*B62B 3/00* (2006.01)

(52) U.S. Cl. ..... 280/648; 280/643; 297/129

(58) Field of Classification Search ..... 280/43, 280/43.1, 43.14, 43.24, 47.18, 47.24, 47.25, 280/47.34, 42, 87.01, 641, 643, 648, 638, 280/639, 642, 647, 650; 297/31, 34, 46, 297/63, 67, 118, 129, 183.1, 183.6, 232, 297/245, 463.1, DIG. 4
See application file for complete search history.

(56) References Cited

U.S. PATENT DOCUMENTS

| | | | | | |
|---|---|---|---|---|---|
| 202,560 | A | * | 4/1878 | Longking | 280/43.14 |
| 1,693,633 | A | * | 12/1928 | Allen | 280/31 |
| 1,921,420 | A | * | 8/1933 | Macourek | 280/43.1 |
| 2,065,233 | A | * | 12/1936 | Mallett | 297/2 |
| 2,150,478 | A | * | 3/1939 | Yerrick | 297/320 |
| 2,546,493 | A | * | 3/1951 | Booth | 403/85 |
| 2,587,176 | A | * | 2/1952 | Larson | 297/31 |
| 3,275,337 | A | * | 9/1966 | Lau | 280/87.1 |
| 3,693,993 | A | * | 9/1972 | Mazzarelli et al. | 280/30 |
| 4,114,914 | A | * | 9/1978 | Cohen | 280/30 |
| 4,319,779 | A | * | 3/1982 | Leonhart | 297/19 |
| 4,376,547 | A | | 3/1983 | Dominko | |
| 4,645,262 | A | * | 2/1987 | Furubotten | 297/129 |
| 4,659,142 | A | * | 4/1987 | Kuchinsky, Jr. | 297/118 |
| 4,703,944 | A | | 11/1987 | Higson | |
| 4,735,426 | A | | 4/1988 | McConnell | |
| 4,838,608 | A | * | 6/1989 | Hansen-Smith et al. | 297/27 |
| 4,934,719 | A | | 6/1990 | duPont | |

(Continued)

FOREIGN PATENT DOCUMENTS

EP 1495677 A1 1/2005

OTHER PUBLICATIONS

Rolling Beach Lounger, http://www.amazon.com/Brookstone-Rolling-Beach-Lounger/dp/B00178HDHC , 4 pages printed form the Internet on Aug. 15, 2008.

*Primary Examiner* — J. Allen Shriver, II
*Assistant Examiner* — Travis Coolman
(74) *Attorney, Agent, or Firm* — Richard C. Litman

(57) ABSTRACT

The dual-chair beach wagon is a rolling cart that can be converted into separately usable beach chairs after a user has finished transporting items with the beach wagon. The cart comprises opposing beach chairs designed with wheels. Beach chairs are removably connected together at opposing ends to form a wagon. When disconnected each chair serves as a standard beach chair. The beach chairs include reconfigurable legs equipped with retractable wheels. In preparation for beach wagon mode, the front legs can be folded up into a recessed locked position to facilitate attachment of the two chairs to form the beach wagon. A rotatable platform joins the axle of one of the chairs to facilitate wagon transport.

7 Claims, 2 Drawing Sheets

U.S. PATENT DOCUMENTS 5,040,807 A 8/1991 Snover
5,120,071 A 6/1992 Thibault et al.
5,265,892 A * 11/1993 Said ..... 280/30
5,356,160 A 10/1994 Urlwin
5,362,079 A 11/1994 Graham
5,364,112 A 11/1994 Jackson
5,492,347 A 2/1996 Palmeri et al.
5,529,375 A * 6/1996 English ..... 297/248
5,857,695 A 1/1999 Crowell
5,944,333 A * 8/1999 Kent ..... 280/204
5,971,483 A 10/1999 Brenneman
6,003,883 A * 12/1999 Brenneman ..... 280/30
6,003,946 A * 12/1999 Jackson ..... 297/377
6,036,148 A * 3/2000 Shank ..... 248/188.5
6,079,777 A 6/2000 Simmons et al.
6,095,607 A * 8/2000 Wenzel ..... 297/344.18
6,312,048 B1 11/2001 Kilmer
6,315,306 B1 11/2001 Fernie et al.
6,527,294 B1 * 3/2003 Brewington et al. ..... 280/647
6,752,405 B1 * 6/2004 Wright ..... 280/47.38
6,811,226 B1 * 11/2004 Kamrath ..... 297/440.14
6,820,928 B1 * 11/2004 Ransom ..... 297/29
6,938,906 B1 * 9/2005 Black ..... 280/47.38
7,226,125 B2 * 6/2007 Frobose et al. ..... 297/158.4
D571,113 S * 6/2008 Cohen ..... D6/368
7,516,966 B2 * 4/2009 Gray ..... 280/47.38
7,896,384 B2 * 3/2011 Schonfeld ..... 280/647
2002/0030350 A1 3/2002 Brotherston
2002/0096856 A1 7/2002 Byrd
2002/0158444 A1 * 10/2002 DeTournay ..... 280/491.2
2004/0178665 A1 9/2004 May
2004/0183265 A1 9/2004 Vecchio
2004/0207240 A1 10/2004 Tondino
2006/0001242 A1 1/2006 Fulks
2006/0071513 A1 4/2006 Pedemonte
2007/0045972 A1 * 3/2007 Thompson ..... 280/47.4
2009/0026733 A1 * 1/2009 Gray ..... 280/643
2010/0044984 A1 * 2/2010 Cohen et al. ..... 280/47.38
2010/0072731 A1 * 3/2010 Thompson ..... 280/642

* cited by examiner

DUAL-CHAIR BEACH WAGON

CROSS-REFERENCE TO RELATED APPLICATION

This application claims the benefit of U.S. Provisional Patent Application Ser. No. 61/136,739, filed Sep. 29, 2008.

BACKGROUND OF THE INVENTION

1. Field of the Invention

The present invention relates generally to portable seating, and more specifically to a dual-chair beach wagon that combines beach chairs to create a beach wagon.

2. Description of the Related Art

A beach wagon is very desirable for beach goers (families) who take lots of items from their car/house to the beach when packing for a day at the beach. Many families take large children's wagons loaded down with beach chairs, beach umbrella, towels, coolers, and beach toys etc. when packing for a day at the beach. The Dual Chair Beach Wagon concept consolidates the beach chairs and beach wagon into one multi purpose item that can reduce some of the many separate items families haul down to the shore.

Also, it would be desirable to have an item that reduces a beach wagon storage area needed in a family's vehicle. So many families have to deal with negotiating space to pack a wagon when packing it on a trip to the beach for the convenience of carrying all their beach items to the shore. The concept of a dual chair beach wagon reduces the storage of a beach wagon down to the storage area of two folded beach chairs.

Thus, a dual-chair beach wagon solving the aforementioned problems is desired.

SUMMARY OF THE INVENTION

The dual-chair beach wagon is a rolling cart that can be converted into separately usable beach chairs after a user has finished transporting items with the beach wagon. The cart comprises opposing beach chairs designed with wheels. Beach chairs are removably connected together at opposing ends to form a wagon. When disconnected each chair serves as a standard beach chair. The beach chairs include reconfigurable legs equipped with retractable wheels. In preparation for beach wagon mode, the front legs can be folded up into a recessed locked position to facilitate attachment of the two chairs to form the beach wagon. A rotatable platform joins the axle of one of the chairs to facilitate wagon transport.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
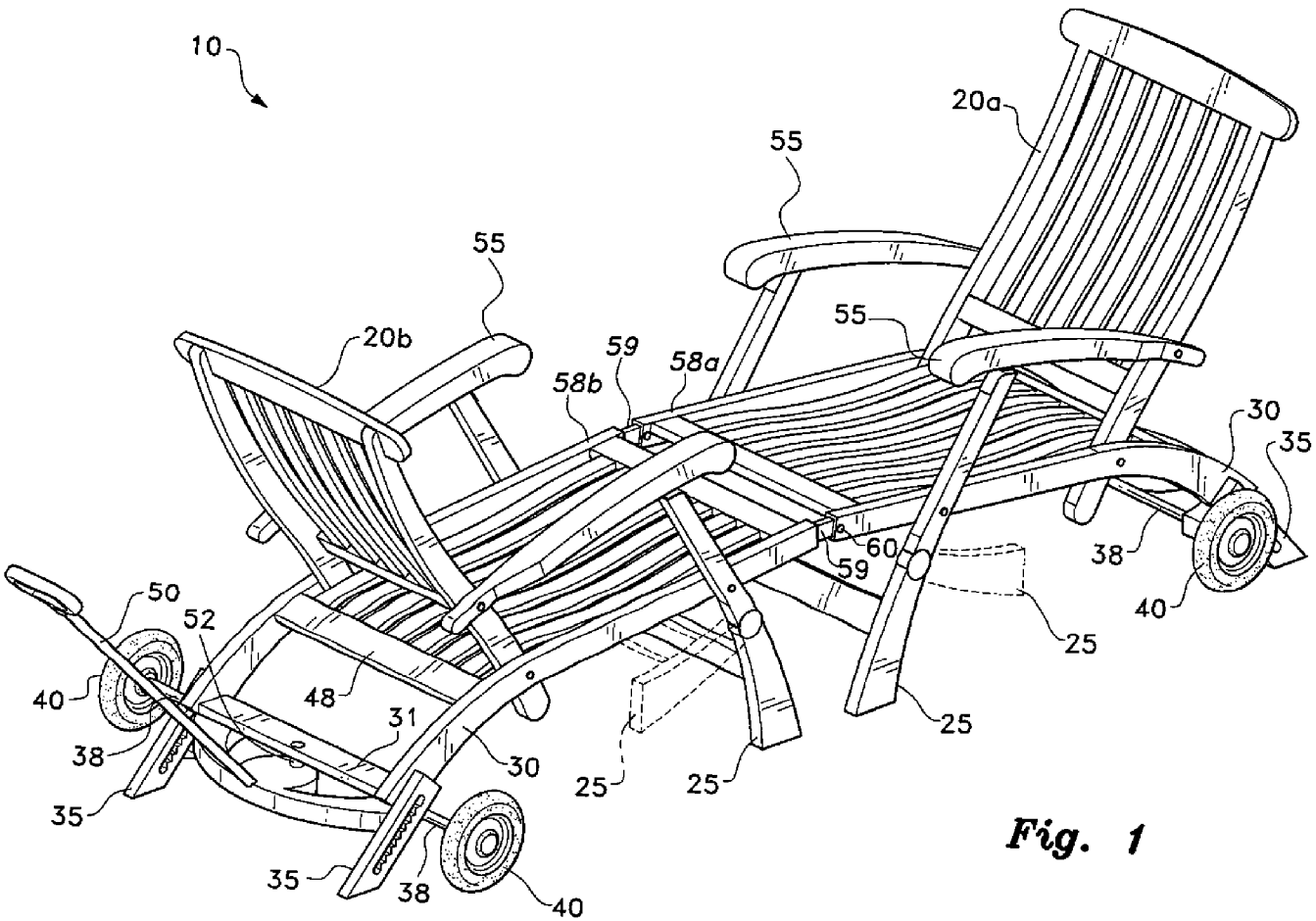
FIG. 1 is an environmental, perspective view of a dual-chair beach wagon according to the present invention.
Figure 2:
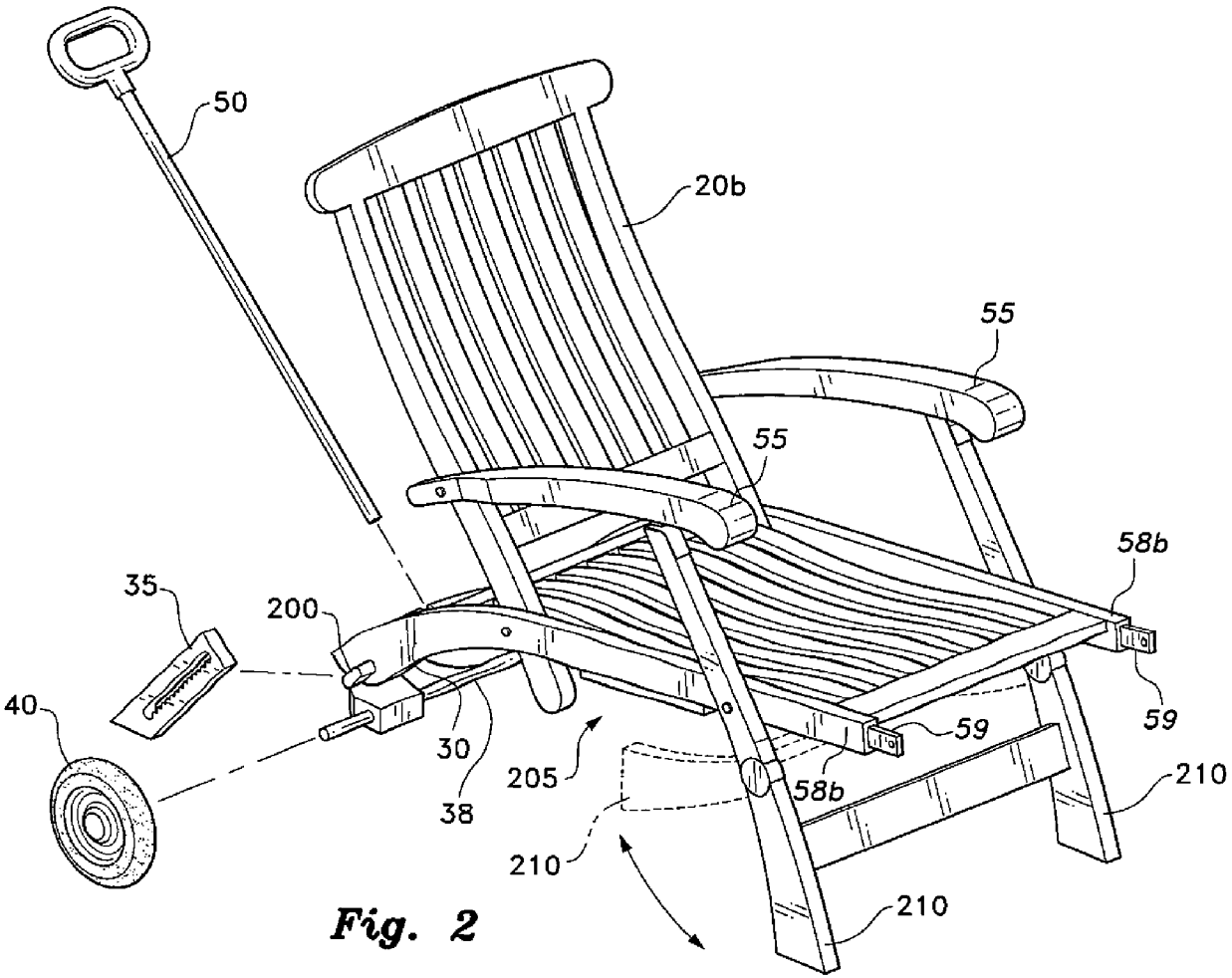
FIG. 2 is a partially exploded, perspective view of the dual-chair beach wagon according to the present invention.

As shown in FIGS. 1 and 2, the dual-chair beach wagon 10 is a device that can be broken down into two beach chairs 20*a* and 20*b*. The beach wagon 10 comprises opposing beach chairs 20*a* and 20*b* and sets of wheels 40 connected to axles 38. Lower frame members 30 form the periphery of seat portion of chairs 20*a* and 20*b*. An extension member 59 extends from front portion 58*b* of beach chair 20*b*. The extension member 59 may be equipped with a recess or through bore proximate its end. Front portion 58*a* of beach chair 20*a* is hollow and adapted to receive extension member 59. Two pins 60 inserted through holes in respective front portions 58*a* of beach chair 20*a* align with the hole or recess in extension member 59 to securely connect the two chairs 20*b* and 20*a* together thus forming the wagon 10. In versions of the chairs where arms 55 are long, the connection may be fortified by attaching the arms 55 as well as front seat portions 58*a* and 58*b*. When disconnected, chair 20*a* and chair 20*b* serve as standard individual beach chairs.

Each of beach chairs 20*a* and 20*b* includes attachment boss 200 disposed on frame member 30 for attachment of reconfigurable legs 35 having a ratchet mechanism and wheels 40 attached to axles 38. The leg can be ratcheted up or down via ratchet mechanism disposed on boss 200. The front legs 25 include a pivotal locking mechanism allowing the legs 25 to be folded away into a recess on the chair when a user desires the beach wagon configuration. Note that front portion of the legs 25 has an arcuate design 210. Legs 25 may be fixed or adjustable. Additionally chair 20*b* has a storage bin 205 disposed under a lower portion of the chair. Hardware or material may be strategically attached on either chair 20*a* or 20*b* allowing for storage compartments that may be suspended from the exterior body of the wagon as when the chairs 20*a* and 20*b* have been assembled.

When the user desires a standard chair configuration, the chair legs 25 may be pulled out from the recessed portion of chairs 20*a* and 20*b* and assembled to form a sturdy forward chair leg assembly.

A steering platform 52 is attached to the wheel assembly, which includes axle 38, the steering platform being pivotally attached to lower cross member 31 of chair 20*b*. A steering handle 50 is attached to front arcuate portion of the steering platform 52. Upper cross member 48 reinforces the rear portion of chair 20*b*.

It is to be understood that the present invention is not limited to the embodiment described above, but encompasses any and all embodiments within the scope of the following claims.

I claim:

1. A dual-chair beach wagon, comprising:

first and second beach chairs, each of the beach chairs have a front portion and a rear portion;

first and second wheel and axle assemblies attached respectively to the first and the second beach chairs;

a first wheel and axle assembly rotatable with respect to the first beach chair;

a handle attached to the first wheel and axle assembly;

adjustable front legs on each of the first and the second beach chairs; and at least one attachment member removably attaching a front portion of the first beach chair to a front portion of the second beach chair, wherein the at least one attachment member is an extension member having a recess, the front portion of at least one of the chairs being hollow and receiving the extension member, whereby the first and second beach chairs have their respective front portions in a face-to-face longitudinal orientation and the first and second wheel and axle assemblies are longitudinally aligned to define the beach wagon.

2. The dual-chair beach wagon according to claim 1, wherein the first and second beach chairs each have lower frame members forming the periphery of seat portions of the chairs.

3. The dual-chair beach wagon according to claim 1, further comprising an upper cross member disposed laterally across the first beach chair, reinforcing a rear portion of said first beach chair proximate said first wheel and axle assembly.

4. The dual-chair beach wagon according to claim 1, further comprising two pins insertable through holes in respective front portions of said second beach chair, the pins aligning with the recess in said extension member, thereby securely connecting said two chairs together.

5. The dual-chair beach wagon according to claim 1, wherein said first and second beach chairs each further comprise chair arms, the chair arms of said first beach chair being removably attachable to the chair arms of said second beach chair.

6. The dual-chair beach wagon according to claim 1, wherein at least one of said chairs includes at least one storage container disposed on a portion thereof.

7. The dual-chair beach wagon according to claim 1, wherein the adjustable front legs are pivotal up into a retracted position and down into a locked, extended position.

* * * * *